US011213839B2

(12) United States Patent
Tani et al.

(10) Patent No.: US 11,213,839 B2
(45) Date of Patent: Jan. 4, 2022

(54) COATING DEVICE

(71) Applicants: TOYOTA JIDOSHA KABUSHIKI KAISHA, Toyota (JP); Trinity Industrial Corporation, Toyota (JP); Ransburg Industrial Finishing K.K., Kanazawa-ku Yokohama (JP)

(72) Inventors: Shinji Tani, Miyoshi (JP); Akira Numasato, Nagoya (JP); Kazuki Tanaka, Toyota (JP); Takahito Kondo, Nisshin (JP); Yuki Murai, Nagoya (JP); Yuki Hirai, Hekinan (JP); Atsushi Tomita, Nagoya (JP); Kenji Okamoto, Tokyo (JP); Naohiro Masuda, Toyota (JP)

(73) Assignees: TOYOTA JIDOSHA KABUSHIKI KAISHA, Toyota (JP); Trinity Industrial Corporation, Toyota (JP); Ransburg Industrial Finishing K.K., Yokohama (JP)

( * ) Notice: Subject to any disclaimer, the term of this patent is extended or adjusted under 35 U.S.C. 154(b) by 45 days.

(21) Appl. No.: 16/549,467

(22) Filed: Aug. 23, 2019

(65) Prior Publication Data

US 2020/0094273 A1 Mar. 26, 2020

(30) Foreign Application Priority Data

Sep. 26, 2018 (JP) ..... JP2018-180709

(51) Int. Cl.
*B05B 5/053* (2006.01)
*B05B 5/04* (2006.01)
*B05B 5/08* (2006.01)

(52) U.S. Cl.
CPC ..... *B05B 5/053* (2013.01); *B05B 5/0407* (2013.01); *B05B 5/08* (2013.01)

(58) Field of Classification Search
USPC ..... 118/620–640, 663, 671, 321, 323
See application file for complete search history.

(56) References Cited

U.S. PATENT DOCUMENTS 4,532,148 A * 7/1985 Vecellio ..... B05B 5/04 118/323
6,595,819 B1 * 7/2003 Kitahara ..... B29C 41/006 118/624
7,617,997 B2 * 11/2009 Nagai ..... B05B 5/0407 118/620

(Continued)

FOREIGN PATENT DOCUMENTS

EP 1655076 A1 5/2006
JP 2002-143726 A 5/2002

(Continued)

*Primary Examiner* — Yewebdar T Tadesse
(74) *Attorney, Agent, or Firm* — Sughrue Mion, PLLC

(57) ABSTRACT

A coating device includes a rotary head, a power supply part that applies a voltage to the rotary head, and a control part that controls the power supply part. The rotary head is configured so that a coating material is electrostatically atomized. The control part is configured so as to calculate a discharge current based on a total current flowing from the power supply part to the rotary head and a leak current, and control the power supply part based on the discharge current.

2 Claims, 6 Drawing Sheets

(56) References Cited

U.S. PATENT DOCUMENTS

| | | | | |
|---|---|---|---|---|
| 8,434,702 | B2 * | 5/2013 | Mori | B05B 5/1675 239/690 |
| 2005/0040262 | A1 | 2/2005 | Nagai | |
| 2009/0108109 | A1 | 4/2009 | Mori et al. | |
| 2017/0056901 | A1 | 3/2017 | Tani et al. | |

FOREIGN PATENT DOCUMENTS

| | | | |
|---|---|---|---|
| JP | 2007-29920 | A | 2/2007 |
| JP | 2017-042749 | A | 3/2017 |
| WO | 2005/009621 | A1 | 2/2005 |

* cited by examiner

COATING DEVICE

INCORPORATION BY REFERENCE

The disclosure of Japanese Patent Application No. 2018-180709 filed on Sep. 26, 2018 including the specification, drawings and abstract is incorporated herein by reference in its entirety.

BACKGROUND

1. Technical Field

The disclosure relates to a coating device.

2. Description of Related Art

A coating device having a rotary head is known (for example, see Japanese Unexamined Patent Application Publication No. 2017-42749 (JP 2017-42749 A)).

The coating device described in JP 2017-42749 A is configured so as to discharge a thread-shaped coating material from the rotary head, and electrostatically atomize the thread-shaped coating material so that coating material particles are formed and a workpiece is coated with the coating material. In the coating device, a high voltage is applied to the rotary head by a voltage generator, and the workpiece is grounded. Therefore, an electric field is formed between the rotary head and the workpiece. In the coating device, since an output voltage of the voltage generator is adjusted in accordance with a distance between the rotary head and the workpiece, fluctuations of electric field strength are restrained, and fluctuations of a discharge current discharged from the rotary head towards the workpiece are restrained. Thus, the electrostatic atomization is stabilized.

SUMMARY

The thread-shaped coating material discharged from the rotary head is split by repulsive force caused by an electrified charge. Therefore, stabilization of a discharge current is desired in order to stabilize the electrostatic atomization. This means that, in order to appropriately control the atomization of the coating material, it is desired to appropriately control a discharge current.

However, in the coating device described above, only the distance between the rotary head and the workpiece is considered as a factor that causes fluctuations of a discharge current at the time of coating, and there is room for improvement. For example, it is considered that a discharge current may fluctuate due to changes of a state of the workpiece because of the coating, changes in a leak current in the coating device, and so on.

The disclosure provides a coating device that is able to appropriately control a discharge current.

A coating device according to an aspect of the disclosure includes a rotary head, a drive part, a coating material supply pipe, a power supply part, and a control part. The drive part rotates the rotary head. The coating material supply pipe supplies a coating material to the rotary head. The power supply part applies a voltage to the rotary head, and the control part controls the power supply part. The rotary head includes a diffusion surface and a plurality of groove portions. On the diffusion surface, the coating material is diffused by centrifugal force to an outer edge portion, and the groove portions are provided in the outer edge portion.

The rotary head is configured so that the thread-shaped coating material is discharged from the groove portions, and that the thread-shaped coating material is electrostatically atomized. The control part is configured so as to calculate a discharge current based on a total current and a leak current and control the power supply part based on the discharge current. The total current flows from the power supply part to the rotary head, and the leak current leaks from the rotary head through the coating material supply pipe. The discharge current is discharged from the rotary head towards a workpiece that is grounded.

As described above, as the discharge current is calculated based on the total current and the leak current, it is possible to estimate the discharge current that is difficult to measure directly. Then, as the power supply part is controlled based on the calculated discharge current, it is possible to appropriately control the discharge current.

In the coating device described above, the control part may be configured so as to control an output voltage of the power supply part so that the discharge current reaches a given target value.

With this configuration, as the output voltage of the power supply part is controlled, it is possible to adjust the discharge current to the given target value.

In the foregoing coating device, a moving part may be provided that moves the rotary head and the workpiece relative to each other. The moving part may be configured so as to prohibit the rotary head and the workpiece from moving closer to each other when an absolute value of the output voltage of the power supply part is smaller than a given value.

With such a configuration, it is possible to restrain the rotary head and the workpiece from coming into contact with each other.

With the coating device according to the aspect of the disclosure, it is possible to appropriately control the discharge current.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, an embodiment of the disclosure is described based on the drawings.

First of all, with reference to FIG. 1 to FIG. 5, a coating device 100 according to the embodiment of the disclosure is described.

Figure 1:
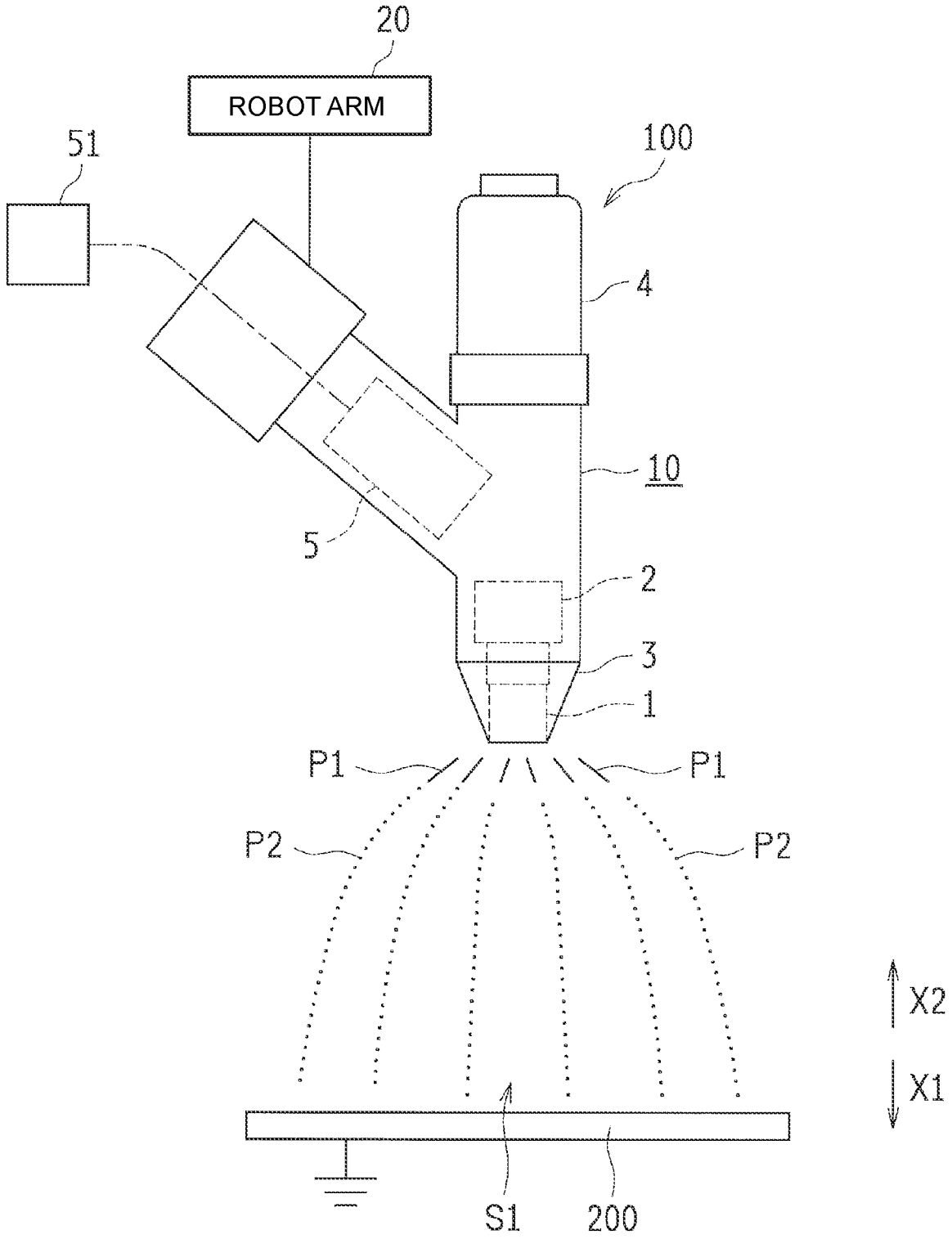
FIG. 1 is a schematic view describing a configuration of a coating device according to an embodiment.

As shown in FIG. 1, the coating device 100 is configured so as to discharge a thread-shaped coating material P1 from a rotary head 1 and electrostatically atomize the thread-shaped coating material P1. Thus, the coating device 100 forms coating material particles (an atomized coating material) P2 and has a workpiece 200 coated with the coating material particles. The workpiece 200 is a coated object that is, for example, a vehicle body.

The coating device 100 includes a spray gun 10 that sprays the coating material, and a robot arm 20 that moves the spray gun 10. The robot arm 20 is provided in order to move the spray gun 10 with respect to the workpiece 200. Therefore, in the coating device 100, it is possible to move the spray gun 10 with respect to the workpiece 200 while coating the workpiece 200 by using the spray gun 10. The robot arm 20 is an example of a "moving part" of the disclosure.

The spray gun 10 includes the rotary head 1, an air motor 2, a cap 3, a coating material supply part 4, and a voltage generator 5. The air motor 2 is an example of a "drive part" of the disclosure, and the voltage generator 5 is an example of a "power supply part" of the disclosure.

The rotary head 1 is configured so that a liquid coating material is supplied to the rotary head 1 and discharged from the rotary head 1 by centrifugal force. As seen in an example in FIG. 2, the rotary head 1 is formed into a cylindrical shape, and includes a mounting part 11 disposed on a base end side (an X2 direction side), and a head part 12 disposed on a distal end side (an X1 direction side). The mounting part 11 is configured so that the mounting part 11 can be mounted on a rotation shaft 21 of the air motor 2. The head part 12 is configured so that the liquid coating material is supplied to the head part 12. A diameter of the rotary head 1 is, for example, 20 mm to 80 mm.

The rotation shaft 21 is mounted on an inner peripheral surface of the mounting part 11. The rotation shaft 21 is formed into a hollow shape, and a coating material supply pipe 6 is disposed inside the rotation shaft 21. The coating material supply pipe 6 is provided in order to supply the coating material stored in the coating material supply part 4 (see FIG. 1) to the head part 12, and a nozzle (not shown) is formed in a distal end 61 of the coating material supply pipe 6.

The head part 12 has an inside surface 12*a* and an outside surface 12*b*, and the inside surface 12*a* is formed so that its diameter expands towards a distal end side. In a center of the inside surface 12*a*, a depressed part 121 is formed, and the depressed part 121 has a circular shape in a view from an axis direction. Also, a hub 13 is provided so as to close the depressed part 121. Therefore, a coating material space S2 is defined by the depressed part 121 and the hub 13, and the distal end 61 of the coating material supply pipe 6 is disposed so as to face the coating material space S2. A plurality of outflow holes 13*a* is formed in an outer edge portion of the hub 13 so that the coating material flows out from the coating material space S2 through the outflow holes 13*a*. The outflow holes 13*a* are disposed at given intervals in a circumferential direction (a rotation direction of the rotary head 1).

The inside surface 12*a* on an outer side of the outflow holes 13*a* in a radial direction (a direction orthogonal to the axis direction of the rotary head 1) functions as a diffusion surface 122 where the coating material is diffused due to centrifugal force. The diffusion surface 122 is formed so that its diameter expands towards the distal end side, and makes the coating material flowing out from the outflow holes 13*a* into a film shape. Further, as shown in FIG. 3, groove portions 123 are formed in an outer edge portion 122*a* of the diffusion surface 122. The groove portions 123 are formed in order to make the film-shaped coating material into a thread shape and discharge the thread-shaped coating material. In consideration of visibility, the groove portions 123 are not shown in FIG. 2.

The groove portions 123 are formed so as to extend in the radial direction in a view in the axis direction, and the number of the groove portions 123 provided is more than one. This means that the groove portions 123 are formed in the outer edge portion 122*a* of the diffusion surface 122 so that the groove portions 123 extend in an inclination direction of the diffusion surface 122. Each of the groove portions 123 is formed so as to have, for example, a V-shaped (triangle) section, and reaches an end portion of the rotary head 1. Therefore, the section of each of the groove portions 123 appears in the outside surface 12*b*, and the distal end of the rotary head 1 has a shape with projections and depressions in a view from an outside surface 12*b* side. The number of the groove portions 123 depends on the diameter of the rotary head 1, and is, for example, 300 to 1800.

As shown in FIG. 1, the air motor 2 is provided in order to rotate the rotary head 1. The air motor 2 has the rotation shaft 21 that is rotatable, and the rotation shaft 21 is connected with the rotary head 1.

The cap 3 (see FIG. 2) is configured so as to cover an outer peripheral surface of the rotary head 1, and is formed into a tapered shape such that a diameter of the cap 3 is reduced towards a distal end side. The cap 3 is formed into an annular shape in a view from the axis direction of the rotary head 1, and the rotary head 1 is disposed inside the cap 3. This means that the cap 3 is provided so as to surround a periphery of the rotary head 1.

Figure 5:
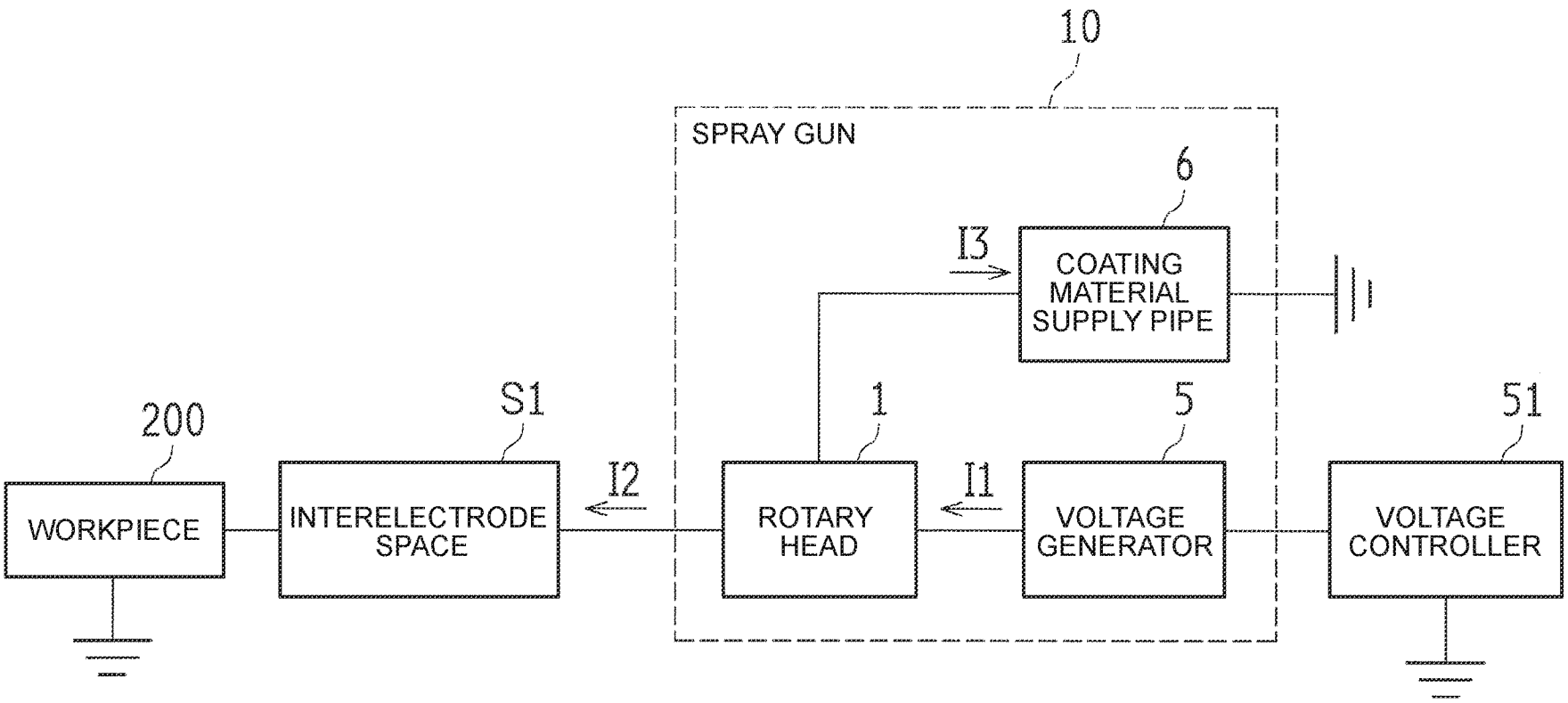
FIG. 5 is a block diagram describing flows of a current in the coating device shown in FIG. 1 at the time of coating.

The coating material supply part 4 is provided in a detachable fashion, and the coating material is stored inside the coating material supply part 4. The coating material stored in the coating material supply part 4 can be supplied to the rotary head 1 through the coating material supply pipe 6 (see FIG. 2). As shown in FIG. 5, the coating material supply pipe 6 is grounded, and configures a part of a leak passage where a leak current I3 leaking from the rotary head 1 flows.

The voltage generator 5 is, for example, a Cockcroft-Walton circuit, and is configured so as to generate a high negative voltage. As an output voltage of the voltage generator 5 is applied to the rotary head 1, an electric field is formed in an interelectrode space S1 between the grounded workpiece 200 and the rotary head 1. A voltage controller 51 is connected with the voltage generator 5, and the voltage controller 51 is configured so as to control the output voltage of the voltage generator 5. The voltage controller 51 is an example of a "control part" of the disclosure.

In the coating device 100, as the thread-shaped coating material P1 is discharged and electrostatically atomized, the coating material particles P2 are formed, and the workpiece 200 is coated with the coating material particles P2. In the coating device 100, since an air discharge part that discharges shaping air is not provided, the coating material particles P2 are formed without using shaping air.

Figure 4:
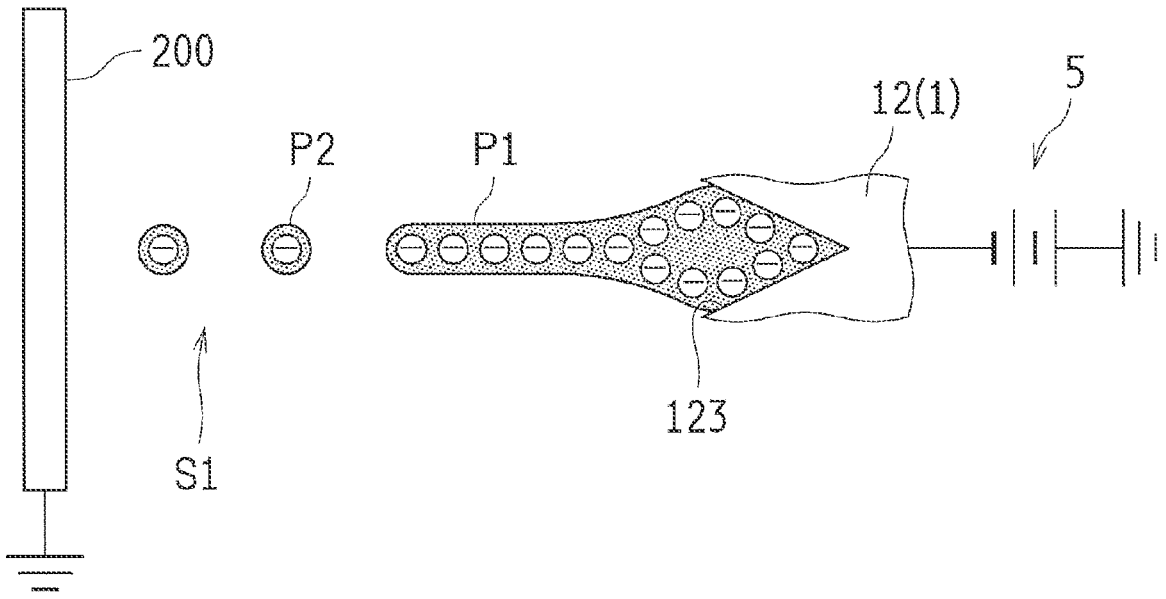
FIG. 4 is a schematic view describing electrostatic atomization carried out by the coating device shown in FIG. 1.

Here, as shown in FIG. 4, the thread-shaped coating material P1 discharged from the rotary head 1 is split by the use of repulsive force caused by an electrified charge. Therefore, in order to stabilize the electrostatic atomization, it is desired that an electric charge be supplied to the thread-shaped coating material P1 in a stable manner so that a discharge current I2 (see FIG. 5) discharged from the rotary head 1 to the workpiece 200 is stabilized. Thus, in order to appropriately control the atomization of the coating material, appropriate control of the discharge current I2 is desired.

However, at the time of coating with the coating device 100, the discharge current I2 may fluctuate. As shown in FIG. 5, the discharge current I2 flows from the rotary head 1 to a ground through the interelectrode space S1 and the workpiece 200. When the coating material particles P2 are applied to an object other than the workpiece 200, a current flows to that object. Therefore, a part of the discharge current I2 can flow through a place other than the workpiece 200. Further, in the spray gun 10, a leak current I3 flows from the rotary head 1 to the ground through the leak passage including the coating material supply pipe 6, and a total current I1 to be divided into the discharge current I2 and the leak current I3 flows from the voltage generator 5 to the rotary head 1.

Therefore, factors that cause fluctuations of the discharge current I2 at the time of coating include, for example, resistance of the interelectrode space S1, resistance of the workpiece 200, and resistance of the leak passage that includes the coating material supply pipe 6. The resistance of the interelectrode space S1 changes depending on a distance between the workpiece 200 and the rotary head 1, a flow rate (a discharge amount) of the coating material, a resistance value of the coating material, and so on. The resistance of the workpiece 200 changes depending on a coating film (not shown) formed in the workpiece 200. The resistance of the leak passage including the coating material supply pipe 6 changes depending on the resistance value and a passage length of the coating material, and so on.

Since the voltage generator 5 generates a high negative voltage, the total current I1, the discharge current I2, and the leak current I3 are negative currents, and directions of their actual currents (when they are positive currents) are opposite to the directions of those negative currents, respectively. Also, a level of the output voltage of the voltage generator 5 means a level of an absolute value of the output voltage.

The voltage controller 51 is configured so as to calculate the discharge current I2 based on the total current I1 and the leak current I3 and control the voltage generator 5 based on the discharge current I2. Specifically, the voltage controller 51 is configured so as to carry out feedback control, thereby controlling the output voltage of the voltage generator 5 so that a current value of the calculated discharge current I2 reaches a given target value. The given target value is a previously-set value, and is a value at which the thread-shaped coating material P1 discharged from the rotary head 1 is electrostatically atomized appropriately. For example, the given target value is set in accordance with a distance between the workpiece 200 and the rotary head 1 and a flow rate of the coating material. Therefore, even when the discharge current I2 fluctuates due to changes of the foregoing factors that cause fluctuations of the discharge current I2, fluctuations of the discharge current I2 are resolved as the output voltage of the voltage generator 5 is controlled. Therefore, the discharge current I2 is stabilized.

For example, the total current I1 is calculated by the voltage controller 51 based on a voltage between given terminals in the voltage generator 5, and the leak current I3 is calculated by the voltage controller 51 based on a voltage at a given position of the leak passage. Since the discharge current I2 can flow to a place other than the workpiece 200, the discharge current I2 is calculated by deducting the leak current I3 from the total current I1.

Further, the robot arm 20 (see FIG. 1) is configured so that the rotary head 1 is prohibited from moving closer to the workpiece 200 when the output value of the voltage generator 5 is smaller than a given value. The given value is a previously-set value and is a threshold value that is used to determine whether or not the rotary head 1 is too close to the workpiece 200.

Example of Operation at the Time of Coating

Next, with reference to FIG. 1 to FIG. 4, an example of an operation at the time of coating by the coating device 100 according to the embodiment is described.

First of all, as shown in FIG. 1, at the time of coating, the voltage generator 5 applies a high negative voltage to the rotary head 1, and the workpiece 200 is grounded. Thus, an electric field is formed in the interelectrode space S1 between the rotary head 1 and the workpiece 200. The high negative voltage is, for example, −30000 V to −70000 V. Further, the distance between the rotary head 1 and the workpiece 200 is a distance as short as, for example, about 50 mm to 100 mm. Here, the voltage controller 51 controls the output voltage of the voltage generator 5. The control of the output voltage of the voltage generator 5 by the voltage controller 51 is described later.

Then, the air motor 2 rotates the rotary head 1. Rotation speed (the number of rotation per minute) of the rotary head 1 depends on the diameter of the rotary head 1, and, is, for example, 10000 rpm to 50000 rpm.

Figure 2:
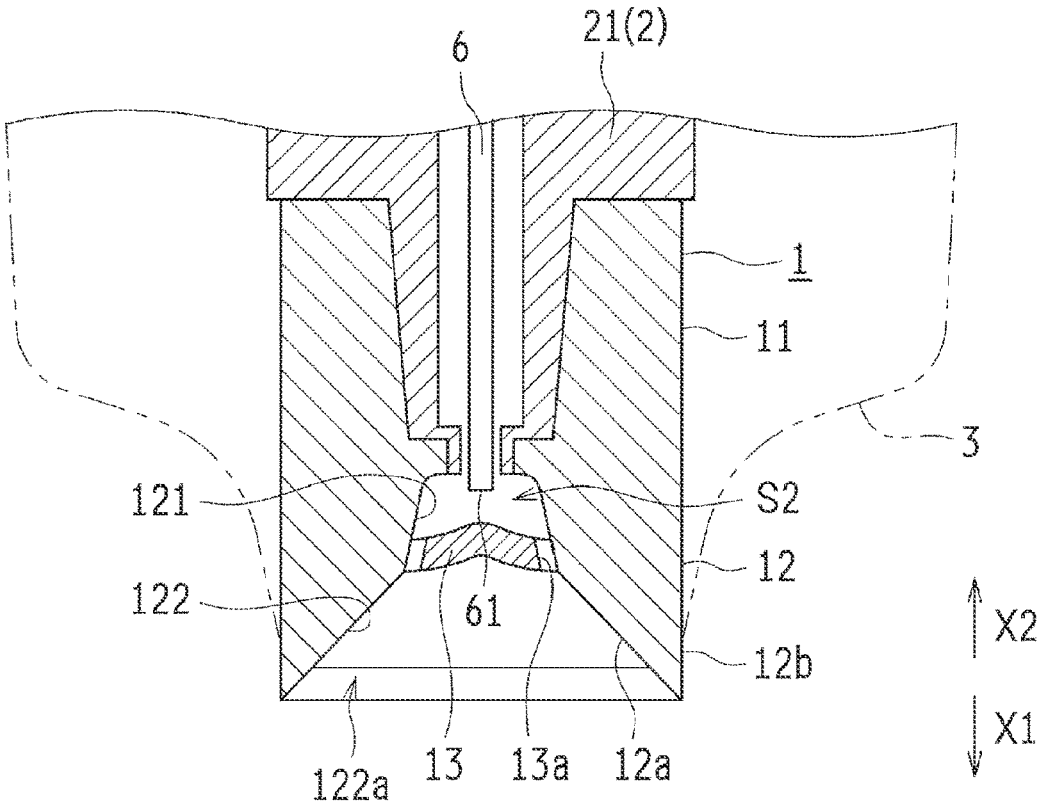
FIG. 2 is a sectional view of a rotary head of the coating device shown in FIG. 1.
Figure 3:
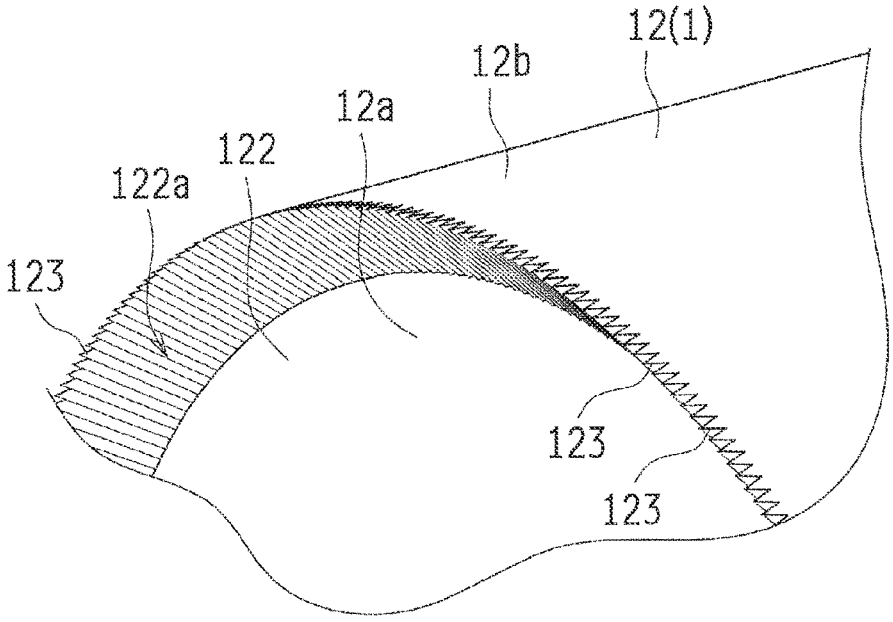
FIG. 3 is a perspective view of a distal end of the rotary head shown in FIG. 2.

Next, as shown in FIG. 2, the liquid coating material is discharged from the nozzle of the coating material supply pipe 6, and the coating material is supplied to the coating material space S2. A flow rate of the coating material discharged from the nozzle depends on the diameter of the rotary head 1, and is, for example, 10 cc/min to 300 cc/min. The coating material supplied to the coating material space S2 flows out from the outflow holes 13*a* due to centrifugal force.

Then, the coating material that flows out from the outflow holes 13*a* flows to the outer side in the radial direction along the diffusion surface 122 due to the centrifugal force. The coating material flowing along the diffusion surface 122 is formed into a film shape, reaches the outer edge portion 122*a*, and is supplied to the groove portions 123 (see FIG. 3). The coating material does not overflow from the groove portions 123 at the outer edge portion 122*a*, and the coating material inside each of the groove portions 123 is separated from the coating material in the neighboring groove portions 123. This means that the film-shaped coating material is divided by the groove portions 123 in the circumferential direction. The coating material that passes the groove portions 123 is formed into a thread shape and discharged from the end portion of the rotary head 1 (parts of the groove portions 123 that appear on the outside surface 12*b*). Due to centrifugal force, the film-shaped coating material has a uniform film thickness, and the coating material is supplied to each of the groove portions 123 almost evenly. Therefore, dimensions (a length and a diameter) of the thread-shaped coating material P1 discharged from each of the groove portions 123 are almost uniform.

As shown in FIG. 4, the thread-shaped coating material P1 discharged from the rotary head 1 is electrostatically atomized, and the coating material particles P2 are thus formed. A particle size of each of the coating material particles P2 is, for example, 10 μm to 50 μm in a Sauter mean diameter. Due to the electric field in the interelectrode space S1, the negatively charged coating material particles P2 are pulled towards the workpiece 200. Accordingly, the workpiece 200 is coated with the coating material particles P2, and a coating film (not shown) is formed on a surface of the workpiece 200.

Example of Control of Output Voltage of Voltage Generator

Figure 6:
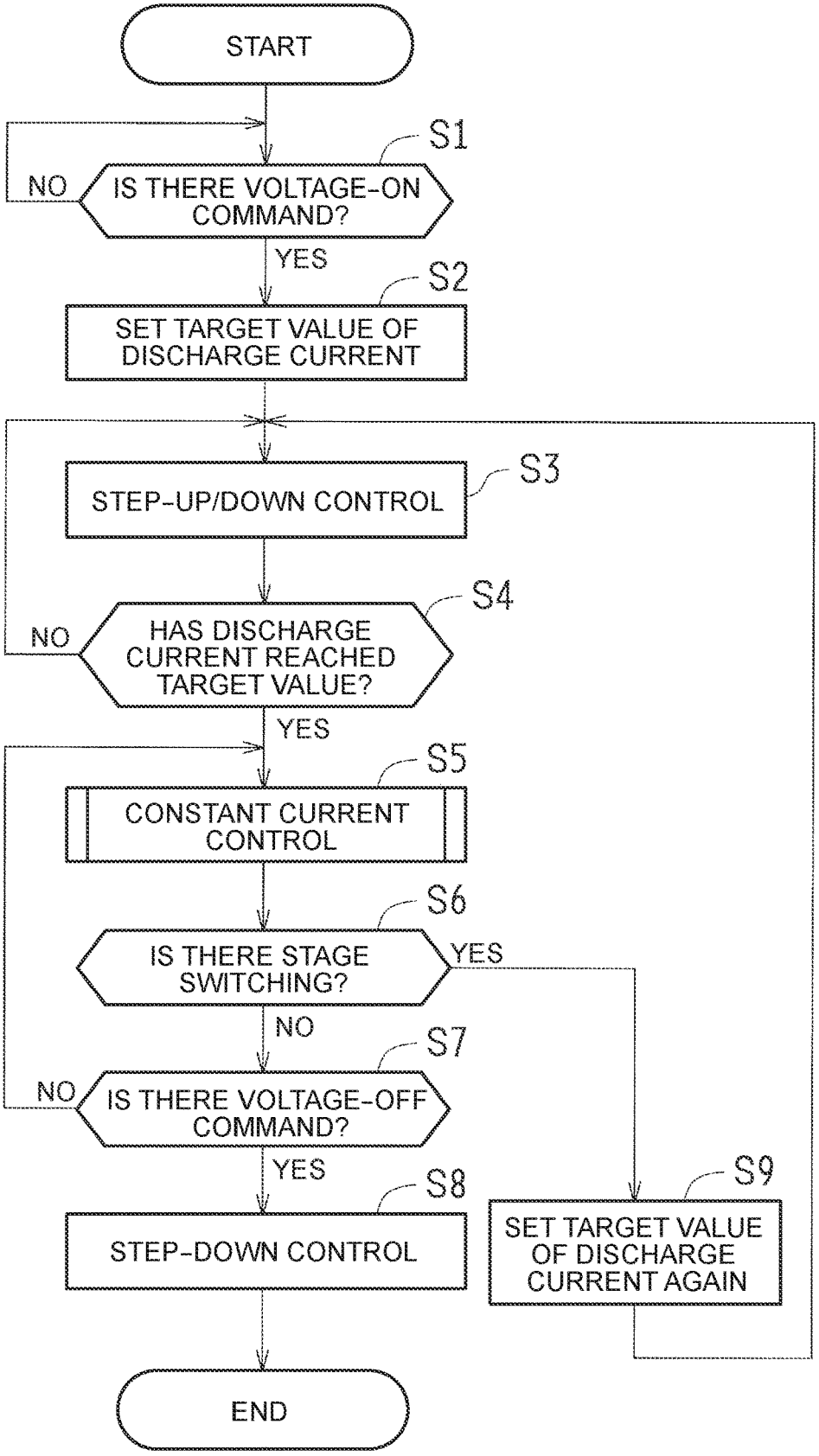
FIG. 6 is a flowchart describing an example of control of an output voltage in the coating device shown in FIG. 1 at the time of coating.
Figure 7:
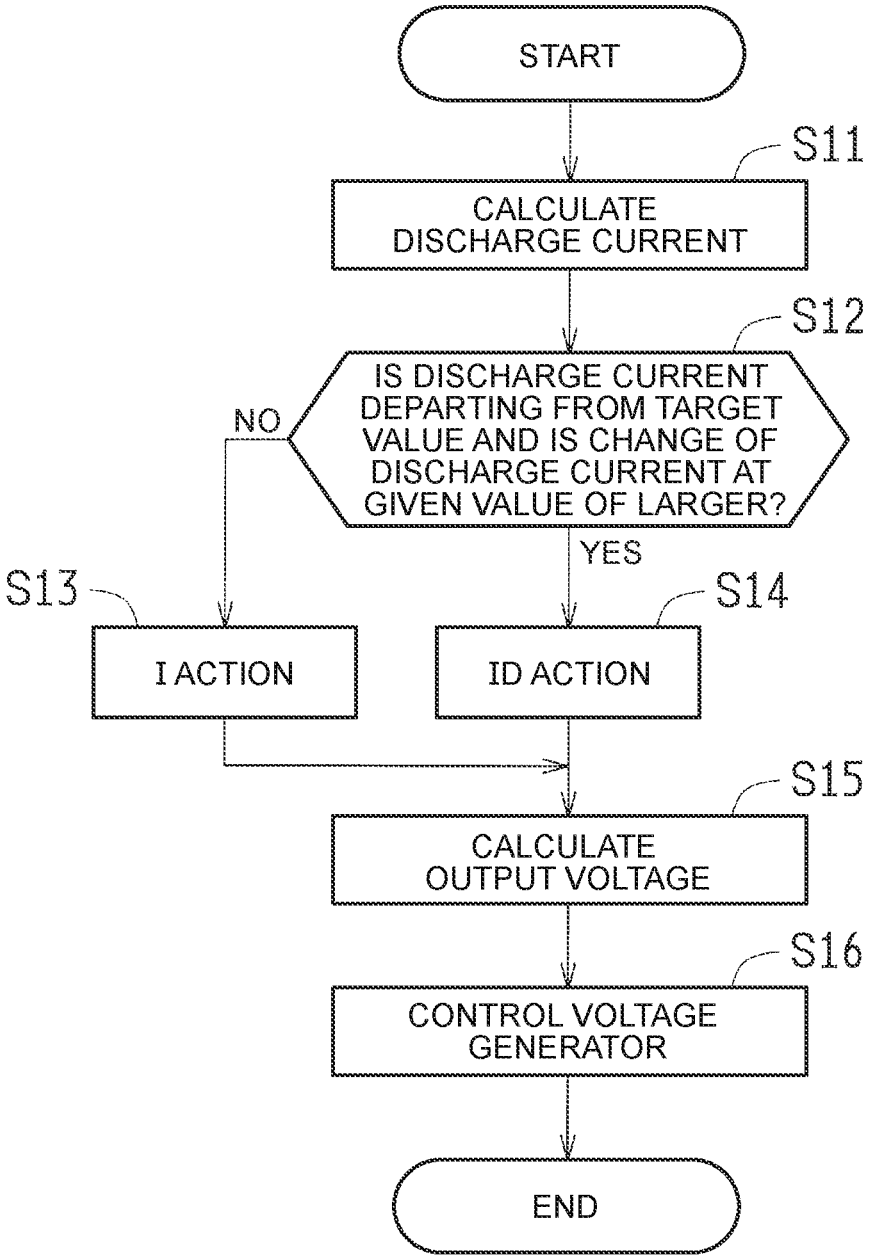
FIG. 7 is a flowchart describing a constant current control in step S5 in FIG. 6.

Next, with reference to FIG. 6 and FIG. 7, an example of control of an output voltage of the voltage generator 5 by the voltage controller 51 is described. The voltage controller 51 executes each step in FIG. 6 and FIG. 7.

First of all, in step S1 in FIG. 6, it is determined whether or not a voltage-on command has been made. For example, when the workpiece 200 is carried to the coating device 100, and preparation for start of coating for the workpiece 200 is completed, the voltage-on command is made. Then, when it is determined that the voltage-on command is made, the processing proceeds to step S2. Meanwhile, when it is determined that the voltage-on command is not made, step S1 is repeated. This means that a stand-by state continues until the voltage-on command is made.

Next, in step S2, a target value of the discharge current I2 is set. As described earlier, the target value is a value that is set in accordance with a distance between the workpiece 200 and the rotary head 1, a flow rate of the coating material, and so on.

Next, in step S3, step-up control is carried out. Specifically, due to a PID action, an output voltage of the voltage generator 5 is controlled so that a current value of the discharge current I2 reaches the target value. The current value of the discharge current I2 is calculated by deducting the leak current I3 from the total current I1. Also, discharge of the coating material begins. In step S9 described later, when the target value of the discharge current I2 is set again, step-down control may be carried out so that a current value of the discharge current I2 reaches the target value.

Next, in step S4, it is determined whether or not the current value of the discharge current I2 reaches the target value. Then, when it is determined that the current value of the discharge current I2 reaches the target value, the processing proceeds to step S5. Meanwhile, when it is determined that the current value of the discharge current I2 has not reached the target value, the processing returns to step S3.

Next, in step S5, constant current control is carried out. The constant current control is carried out in order to maintain the discharge current I2 at the target value. At this moment, the robot arm 20 moves the spray gun 10 with respect to the workpiece 200 while the coating material is being sprayed from the rotary head 1 for coating.

In the constant current control, first of all, the current value of the discharge current I2 is calculated in step S11 in FIG. 7.

Next, in step S12, it is determined whether or not the discharge current I2 is departing from the target value, and also whether or not a change of the discharge current I2 is a given value or larger. Then, when it is determined that the discharge current I2 is not departing from the target value, and when it is also determined that the change of the discharge current I2 is smaller than the given value, the processing proceeds to step S13. Meanwhile, when it is determined that the discharge current I2 is departing from the target value and a change of the discharge current I2 is the given value or larger, which means that the discharge current I2 changes dramatically, the processing proceeds to the step S14.

Next, in step S13, an I action is carried out so that the current value of the discharge current I2 reaches the target value. This means that a proportional term and a derivative term are zero, and only integral control is carried out. In the I action, when the current value of the discharge current I2 is the target value or smaller, a positive correction value is calculated, and, when the current value of the discharge current I2 exceeds the target value, a negative correction value is calculated.

Further, in step S14, an ID action is carried out so that the current value of the discharge current I2 reaches the target value. This means that derivative control is also carried out in order to help the integral control for quickly responding to a sudden change of the discharge current I2.

Then, in step S15, an output voltage of the voltage generator 5 after the I action or the ID action is calculated. Thereafter, in step S16, the voltage generator 5 is controlled so that the voltage calculated in the step S15 is output.

As the constant current control is carried out as described above, even when the discharge current I2 fluctuates due to changes of factors that cause fluctuations of the discharge current I2, it is possible to cancel the fluctuations.

Next, in step S6 in FIG. 6, it is determined whether or not there is stage switching. The stage switching means that a coating condition (for example, a distance between the workpiece 200 and the rotary head 1) is changed. Then, when it is determined that there is no stage switching, the processing proceeds to step S7. Meanwhile, when it is determined that there is the stage switching, the processing proceeds to step S9.

Next, in step S7, it is determined whether or not a voltage-off command is made. The voltage-off command is made when, for example, coating of the workpiece 200 is completed, or when emergency stop is necessary due to occurrence of abnormality. Then, when it is determined that the voltage-off command is not made, the processing returns to step S5. Meanwhile, when it is determined that the voltage-off command is made, discharge of the coating material is stopped, and the processing proceeds to step S8.

Next, in step S8, as the step-down control is carried out, the output voltage of the voltage generator 5 becomes zero, and the processing is terminated.

Further, when there is the stage switching (YES in step S6), the target value of the discharge current I2 is set again in step S9, and the processing returns to step S3. The target value that is set again is a target value in accordance with the changed coating condition.

Effects

In the embodiment, the discharge current I2 is calculated based on the total current I1 and the leak current I3 as described above, and it is thus possible to estimate the discharge current I2 that is difficult to measure directly. Then, as the voltage generator 5 is controlled based on the calculated discharge current I2, it is possible to control the discharge current I2 appropriately. Therefore, even when the discharge current I2 fluctuates due to changes of the factors that cause fluctuations of the discharge current I2, fluctuations of the discharge current I2 are resolved as the voltage generator 5 is controlled. Therefore, it is possible to stabilize the discharge current I2.

For example, when the distance between the workpiece 200 and the rotary head 1 becomes long and the discharge current I2 is decreased, the decrease in the discharge current I2 is detected, and an output voltage of the voltage generator 5 is increased in order to cancel the decrease in the discharge current I2. Meanwhile, when the distance between the workpiece 200 and the rotary head 1 becomes short and the discharge current I2 increases, the increase in the discharge current I2 is detected and an output voltage of the voltage generator 5 is decreased in order to cancel the increase in the discharge current I2.

Further, when a coating film is formed on the workpiece 200, the resistance of the workpiece 200 becomes high as the coating film is formed, and the discharge current I2 is decreased. Then, the decrease in the discharge current I2 is detected, and an output voltage of the voltage generator 5 is increased in order to cancel the decrease in the discharge current I2. Further, when the discharge current I2 is decreased because the resistance of the leak passage including the coating material supply pipe 6 is decreased and the leak current I3 increases, the decrease in the discharge current I2 is detected, and then an output voltage of the voltage generator 5 is increased so that the decrease in the discharge current I2 is canceled. Meanwhile, when the discharge current I2 is increased because the resistance of the leak passage including the coating material supply pipe 6 increases and the leak current I3 is decreased, the increase in the discharge current I2 is detected, and then an output voltage of the voltage generator 5 is decreased so as to cancel the increase in the discharge current I2.

As described above, it is possible to stabilize the discharge current I2 by addressing various factors that cause fluctuations of the discharge current I2 (for example, the resistance of the interelectrode space S1, the resistance of the workpiece 200, and the resistance of the leak passage including the coating material supply pipe 6). As a result, it is possible to stabilize the electrostatic atomization of the thread-shaped coating material P1 discharged from the rotary head 1, thereby improving coating quality.

Further, in the embodiment, as the constant current control is carried out, the output voltage is reduced as the rotary head 1 moves closer to the workpiece 200, thereby repressing generation of sparks. Therefore, it is possible to move the rotary head 1 closer to the workpiece 200. However, when the rotary head 1 is too close to the workpiece 200, the rotary head 1 could come into contact with the workpiece 200. Therefore, when the output voltage of the voltage generator 5 is smaller than a given value, the rotary head 1 is prohibited from moving closer to the workpiece 200. Thus, it is possible to restrain the rotary head 1 from coming into contact with the workpiece 200.

Other Embodiments

The embodiment disclosed herein is an example in every aspect, and is not a basis of limited interpretation of the disclosure. Therefore, the technical scope of the disclosure is not interpreted based solely on the embodiment described above, and shall be defined based on description in the scope of claims. Also, the technical scope of the disclosure includes all changes within the scope of claims, as well as meaning equivalent to the scope of the claims.

For example, in the embodiment, the example is shown in which the workpiece 200 is a vehicle body. However, the disclosure is not limited to this, and the workpiece may be something other than the vehicle body.

In the embodiment, the example is described in which the total current I1 is calculated based on a voltage between given terminals of the voltage generator 5. However, the disclosure is not limited to this. A current sensor (not shown) may be provided between the voltage generator and the rotary head, and a total current detected by the current sensor may be input to the voltage controller.

Further, in the foregoing embodiment, the example is described in which the leak current I3 is calculated based on a voltage at a given position of the leak passage. However, the disclosure is not limited to this. A current sensor (not shown) may be provided in the leak passage, and a leak current detected by the current sensor may be input to the voltage controller.

Further, in the embodiment, the target value of the discharge current I2 is set in accordance with a distance between the workpiece 200 and the rotary head 1, a flow rate of the coating material, and so on. However, the disclosure is not limited to this. The target value of the discharge current may be set in accordance with a distance between the workpiece and the rotary head, a flow rate of the coating material, a type of the coating material, a type (a material) of the workpiece, rotation speed of the rotary head, and so on.

Also, in the foregoing embodiment, the example is described in which the processing proceeds to the constant current control when a current value of the discharge current I2 reaches the target value. However, the disclosure is not limited to this. The processing may proceed to the constant current control when the current value of the discharge current reaches the vicinity of the target value.

Further, in the foregoing embodiment, the example is described in which the spray gun 10 is moved by the robot arm 20. However, the disclosure is not limited to this. The spray gun may be fixed, and the workpiece may be moved with respect to the spray gun.

Further, in the foregoing embodiment, the example is described in which the rotary head 1 is formed in the cylindrical shape. However, the disclosure is not limited to this. The rotary head may be formed into a cup shape (a bowl shape).

Also, in the foregoing embodiment, the example is described in which each of the groove portions 123 has a V-shaped section. However, the disclosure is not limited to this, and the section of each of the groove portions may be another shape, such as a U-shape (an arc shape).

Further, in the foregoing embodiment, the example is described in which the outflow holes 13*a* are formed so that the coating material is allowed to flow out from the coating material space S2. However, the disclosure is not limited to this, and slit-shaped grooves may be formed to allow the coating material to flow from the coating material space.

Further, in the foregoing embodiment, the coating material may be a water-based coating material, or a solvent-based coating material.

The disclosure is applicable to a coating device including a rotary head.

The invention claimed is:

1. A coating device comprising:

a rotary head;

a drive part that rotates the rotary head;

a coating material supply pipe that supplies a coating material to the rotary head;

a power supply part that applies a voltage to the rotary head;

a control part that controls the power supply part, and a moving part that moves the rotary head and the workpiece relative to each other, wherein:

the rotary head includes a diffusion surface where the coating material is diffused by centrifugal force to an outer edge portion, and a plurality of groove portions provided in the outer edge portion, the rotary head being configured so that the thread-shaped coating material is discharged from the groove portions, and that the thread-shaped coating material is electrostatically atomized;

the control part is configured so as to calculate a discharge current based on a total current flowing from the power supply part to the rotary head, and a leak current that leaks from the rotary head through the coating material supply pipe, and control the power supply part based on the discharge current, the discharge current being discharged from the rotary head towards a workpiece that is grounded; and the moving part is configured to prohibit the rotary head and the workpiece from moving closer to each other when an absolute value of an output voltage of the power supply part is smaller than a given value.

2. The coating device according to claim 1, wherein the control part is configured so as to control the output voltage of the power supply part so that the discharge current reaches a given target value.

* * * * *